US006159096A

United States Patent [19]

Yoseloff

[11] Patent Number: 6,159,096

[45] **Date of Patent: *Dec. 12, 2000**

[54] METHOD AND APPARATUS FOR CONFIGURING A SLOT-TYPE WAGERING GAME

[75] Inventor: Mark L. Yoseloff, Henderson, Nev.

[73] Assignee: Shuffle Master, Inc., Eden Prairie, Minn.

[ * ] Notice: This patent is subject to a terminal disclaimer.

[21] Appl. No.: 08/989,369

[22] Filed: Dec. 12, 1997

[51] Int. Cl.[7] ..... A63B 15/00

[52] U.S. Cl. ..... 463/20; 273/138.1; 273/143 R

[58] Field of Search ..... 463/20–22, 16–19, 463/12, 13, 30, 31; 273/143 R, 138.1, 138.2, 138.3, FOR 143 R, 138 A

[56] References Cited

U.S. PATENT DOCUMENTS

| | | | |
|---|---|---|---|
| 4,095,795 | 6/1978 | Saxton et al. | 273/143 R |
| 4,238,127 | 12/1980 | Lucero et al. . | |
| 4,448,419 | 5/1984 | Telnaes | 273/143 R |
| 4,573,681 | 3/1986 | Okada et al. | 463/21 |
| 4,772,023 | 9/1988 | Okada et al. | 273/143 R |
| 5,083,785 | 1/1992 | Okada . | |
| 5,102,134 | 4/1992 | Smyth . | |
| 5,209,479 | 5/1993 | Nagao et al. | 463/21 |
| 5,219,167 | 6/1993 | Hamano | 273/143 R |
| 5,263,716 | 11/1993 | Smyth . | |
| 5,380,008 | 1/1995 | Mathis et al. . | |
| 5,393,061 | 2/1995 | Manship et al. | 273/143 R |
| 5,423,539 | 6/1995 | Nagao | 273/143 R |
| 5,456,465 | 10/1995 | Durham | 273/138 A |
| 5,569,084 | 10/1996 | Nicastro et al. | 463/20 |
| 5,988,638 | 12/1999 | Rodesch et al. . | |
| 6,003,867 | 12/1999 | Rodesch et al. . | |

*Primary Examiner*—Jessica J. Harrison
*Assistant Examiner*—Sheila Clayton
*Attorney, Agent, or Firm*—Jennifer K. Farrar

[57] ABSTRACT

A method of configuring a reel-slot gaming device to randomly generate game outcome is disclosed. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for defining the variables, defining payouts for selected outcomes, and configuring a reel-slot gaming device having X reels, which randomly selects a template, randomlu selects a symbol for each position in the template from the subset of game symbols assigned to the selected template, randomly fills at least a portion of the positions in the template and displays the outcome. A gaming device configured to randomly generate game outcomes is also disclosed.

20 Claims, 3 Drawing Sheets

METHOD AND APPARATUS FOR CONFIGURING A SLOT-TYPE WAGERING GAME

BACKGROUND OF THE INVENTION

The present invention relates to games of chance. In particular, it relates to a method of configuring a reel-slot game to achieve a desired probability of occurrence of certain game outcomes. This application has been filed concurrently with and on the same date as my related application for Method and Apparatus for Configuring a Video Output Gaming Device, whose disclosure is incorporated by reference.

Reel-slot machines are among the most popular wagering devices in the United States at this time. A typical mechanical slot machine is a three reel device, that is configured to randomly display three symbols on one or more pay lines from a number of symbol bearing reels.

With conventional mechanical reel-slot machines, the probability of occurrence of any particular three symbol game outcome is dictated by the game designer's choice of symbols, the number of reels, the number of positions on each reel and the number of times each symbol appears on each reel.

The frequency of occurrence, or "hit frequency" of each possible outcome, in combination with the percentage of coins dropped, or "hold" are considered in defining one or more pay tables for a given game. The physical configuration of a typical mechanical reel-slot machine therefore imposes a practical limit on the maximum payout on mechanical reel slot machine outcomes.

Game designers have been presented with the challenge of designing reel-slot games that permit symbol combinations with a hit frequency low enough to raise the value of the prize. Higher payouts are desirable because they are believed to attract more players to the game. Machines that pay higher payouts are also thought to attract additional players, namely those interested in betting on a long shot. Conventional mechanical reel-slot machines cannot be configured to provide opportunities for earning larger payouts, such as progressive payouts because of the physical limitations described above.

The minimum probability of a payout for conventional slot machines is 1 in N raised to the power R, where N is the number of angular rotational positions on each reel and R is the number of reels. The lowest probability that can be offered on a three reel, twenty reel stop position per reel machine would therefore be 1 in 8000 (20 to the third power).

Game designers have attempted to overcome the physical limitations of standard reel-slot machines on pay tables by designing games with additional and bigger reels. Additional and larger reels permit a larger number of symbol combinations and therefore increase the size of the prize for certain winning combinations.

Larger reel machines have not been well accepted by casino patrons. The larger machines are perceived as having less favorable odds of achieving winning symbol combinations. The mechanical equipment used to physically stop and lock the reels in a conventional reel-slot machine can also wear out and produce outcomes that are not purely random.

Electromechanical reel-slot machines have been introduced in an attempt to improve the reliability of conventional reel-slot machines. Electromechanical reel-slot machines are equipped with random number generators which select numbers assigned to each angular position on the reel. Electromechanical reel-slot machines include a device to stop the reel at the selected angular position. However, these machines still have the physical size and configuration which limits the size of the prize and the hit frequencies.

The inherent payout limitations of mechanical and electromechanical reel-slot machines have been overcome in part by offering machines configured according to a method disclosed in Telnaes U.S. Pat. No. 4,448,419.

Telnaes describes a method of providing payout odds which are independent of the hit frequencies determined by the geometry of a reel-slot machine. "Virtual" addresses are provided on one or more reels. For example, in a twenty reel stop position reel, position 19 may be assigned random numbers 1 and 21. When the random number generator selects 21, for example, a microprocessor instructs the device to display the symbol assigned to "virtual" stop 21. The microprocessor then instructs the reel to stop at a reel stop position bearing a symbol that matches the symbol assigned to virtual stop 21. This position need not be position 19.

This technology advantageously allows the game designer to define the probability of occurrence of a selected symbol that is different from a conventional three reel-slot machine. For example, a cherry symbol might be present on only one out of twenty reel stop positions, with a probability of occurrence of 1/20 or 0.05 for a cherry on that particular reel. By providing, for example, a reel with 60 "virtual" reel positions, and by assigning a cherry symbol to two of the addresses, the odds of the cherry appearing on the same reel can be changed from 1 in 20 (0.05) to 2 in 60 or (0.0333).

Although this technology is a vast improvement over conventional reel-slot devices, it still possesses certain disadvantages. The random number generator selects numbers corresponding to "virtual" stop positions on each reel independently of the other reels. Utilizing the Telnaes technology, the game designer is able to modify the probability of occurrence of certain game symbols, but the probability of occurrence of all possible game outcomes is completely dependent upon the selected number of reels, the number of virtual reel positions and the symbols assigned to each virtual reel position. In other words, the probability of occurrence of all possible game outcomes, including game outcomes requiring certain symbols to appear in a predetermined order on the pay line (hereinafter referred to as a "positional win") and consequently payoffs cannot independently be assigned their own probability of occurrence practicing this method. For this reason, Telnaes does not provide the game designer with enough flexibility in determining the frequency of occurrence of certain combinations of symbols. For example, if a positional win consisting of Cherry, Double Bar and Double Bar, in that order, is designated as the highest winning combination, under Telnaes, it might not be possible to offer other combinations with a cherry symbol appearing in a lower ranked combination because the probabilities of occurrence of the cherry in the first position in the different outcomes does not coincide with the probability needed to cause the cherry to appear frequently enough in other outcomes.

Nicastro et al. U.S. Pat. No. 5,569,084 describes a method of selecting a probability of occurrence of selected symbol combinations in a reel-slot game. According to a first example of the Nicastro method, all possible game outcomes (symbol combinations) are first defined. Each outcome is assigned to a position on a "branching tree" stored in ROM memory. The branching tree includes a main tier, branching tiers and terminal nodes. In the first example, each possible outcome is assigned to a terminal node. Each branching tier is assigned a probability of occurrence. This probability, along with the number of terminal nodes assigned to the branching tier determines the probability of occurrence of the symbol combination assigned to the terminal node. By selecting the position of each outcome on the branching tree, and the number of terminal nodes, if any, the probability of occurrence of each outcome is defined.

The Nicastro method identifies all possible outcomes, then assigns a probability of occurrence to each outcome. This in turn defines the relative probability of occurrence of each game symbol. The Nicastro method does not randomly and independently select each symbol on the pay line. Nor does this method teach that it would be desirable to randomly and independently select each symbol on the pay line.

In a second example illustrated in Nicastro, a single symbol is assigned to each terminal node, and then a random number generator selects a terminal node for each symbol selected. The symbols are independently and randomly selected. In this example, the method does not permit the game designer to assign a probability of occurrence to certain symbol combinations independently of assigning a probability of occurrence to the individual symbols.

Durham U.S. Pat. No. 5,456,465 describes a method for operating a microprocessor based reel-slot machine. According to the method described by Durham, all possible symbol combinations in a reel-slot game are defined, and assigned a payout value. A random number generator selects a first multiplier number, and then a second multiplier number. The numbers are multiplied to arrive at a payout value. A random number generator then selects a single symbol combination from the set of symbol combinations assigned that particular payout value. The symbols are then displayed on the pay line. According to the method described by Durham, all game outcomes are preselected, and are then assigned a payout value. The Durham method does not describe a method of randomly and independently selecting each symbol in an outcome.

The Durham and Nicastro (first example) methods utilize different techniques for assigning a probability of occurrence to a set of preselected game outcomes. Telnaes and Nicastro (second example) do not teach a method of assigning probabilities of occurrence to certain game outcomes independently of assigning a probability of occurrence to individual symbols. The probability of occurrence of game outcomes according to Telnaes and Nicastro (second example) cannot be "tuned" independently of the probability of occurrence of each game symbol.

It would be desirable to combine the ability to randomly select each symbol appearing on the pay line based on the assigned relative probability of occurrence of each game symbol and at the same time assign a probability of occurrence to certain categories of game outcomes. It would also be desirable to provide a method of configuring a gaming device having a preselected number of game outcome templates, whose game outcome templates can be assigned a probability of occurrence independently of the assigned probability of occurrence of the individual game symbols used to fill the template. It would also be desirable to define a game utilizing the method of the present invention to display all of or fewer than all possible outcomes.

SUMMARY OF THE INVENTION

The present invention is a method of configuring a reel-slot gaming device to randomly generate game outcomes. The preferred method includes the steps of selecting a set of game symbols and assigning a relative probability of occurrence to each game symbol. The method of the present invention includes the step of selecting a plurality of outcome templates, each template having X variables. Each variable in the template corresponds to a reel on the reel-slot gaming device.

The method includes selecting and assigning a probability of occurrence to each outcome template. Next, a subset of game symbols from the complete set of game symbols is selected and is assigned to each outcome template. Payouts are defined for selected game outcomes. The last step of the present method includes configuring a reel-slot gaming device, having X numbers of reels, which randomly selects an outcome template, randomly selects symbols from the subset of game symbols corresponding to that template to fill each variable in the template, fills at least a portion of the template randomly with selected symbols and displays the selected symbols, preferably on a pay line of a reel-slot device.

A reel-slot wagering device is disclosed. The device includes a cabinet, player controls mounted in the cabinet, a plurality of reels rotatable about a central axis and mounted for rotation in the cabinet, a visual display including at least one pay line, and a microprocessor which communicates with the player controls and reels. The microprocessor is programmed with a set of game symbols, and an assigned relative probability of occurrence of each game symbol. The microprocessor is programmed with a plurality of game templates, each having X variables. A subset of symbols is assigned to each template, and limits the manner in which the variables are defined. The symbols in each subset are part of the set of game symbols. Each template is assigned a relative probability of occurrence, and this probability information is also programmed into the microprocessor.

A preselected group of winning combinations and corresponding pay values is also programmed into the microprocessor. When the game is played, a random number generator is utilized by the microprocessor to select a game template and fill the variables in the template from the subset of symbols assigned to the template. Preferably, the order in which the symbols are filled is random, and the order in which the resulting outcome symbols are displayed is also random. A payout is awarded if the player achieves a winning outcome.

DETAILED DESCRIPTION OF THE PREFERRED EMBODIMENTS

The present invention is a method for configuring a gaming device which permits the game designer to define a number of outcome templates, and assign a probability of occurrence to each template independently of selecting a probability of occurrence of each game symbol. Once the template is randomly selected, according to the present method, each symbol used to fill the variables within the template is randomly selected from a subset of symbols assigned to that template. After each of the symbols is selected, according to the present invention, the order in which the selected symbols appear on the pay line is randomly determined. The method of the present invention advantageously permits random selection of individual symbols, rather than combinations of symbols.

The present invention applies to reel-slot gaming devices, namely those gaming devices employing a microprocessor with a random number generator to determine game outcomes. Although the example described below is a method of configuring a three reel-slot machine with a single pay line, the method of the present invention can be applied to virtually any type of reel-slot device with varying numbers of reels, reel positions, symbols, winning combinations and pay lines.

The present method is not only useful for configuring gaming devices whose object is to match like symbols, but also has application for games whose object is to match dissimilar symbols. The present method is believed to be particularly well suited for application in connection with microprocessor-based electromechanical reel-slot machines.

Figure 1:
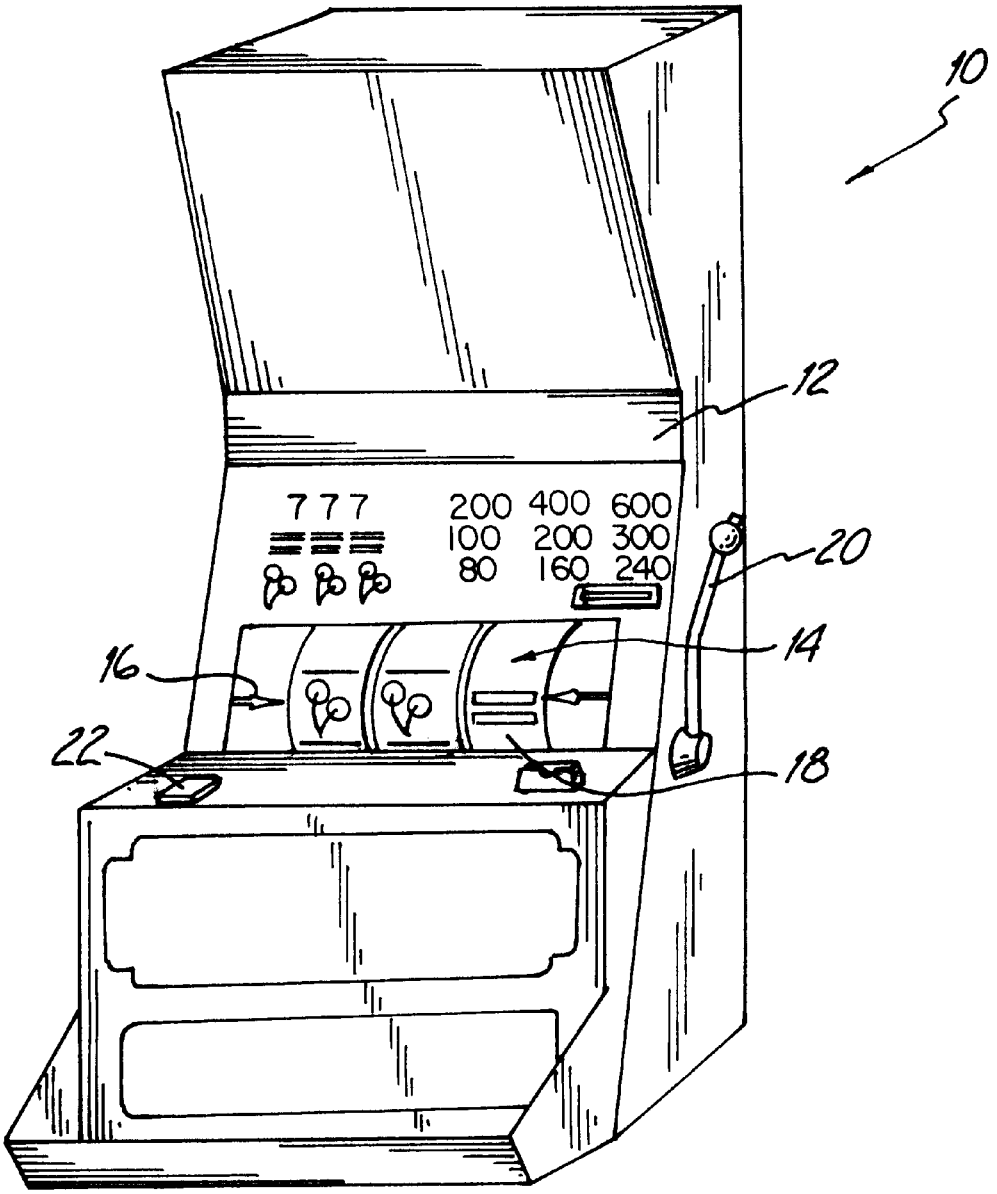
FIG. 1 is a perspective view of a preferred three reel-slot machine configured according to the method of the present invention.

Referring now to FIG. 1, an electromechanical slot machine 10 configured according to the method of the present invention is equipped with a cabinet 12, a microprocessor mounted in the cabinet (not shown), a display area 14 with at least one pay line 16 and a plurality of reels 18 that are at least partially visible in the display area 14. Each reel 18 is mounted for rotation about a common axis. Upon activation by either pulling the lever 20 or activating a "spin" button 22, the three reels 18 begin to spin. The microprocessor (not shown) includes memory (not shown) and a random number generator (not shown). According to the preferred embodiment, three mechanical reels are provided, each with twenty physical reel stop positions. The microprocessor determines the symbols that will be displayed, and then instructs a braking device to stop the reel at a position corresponding to the selected symbol.

Figure 2:
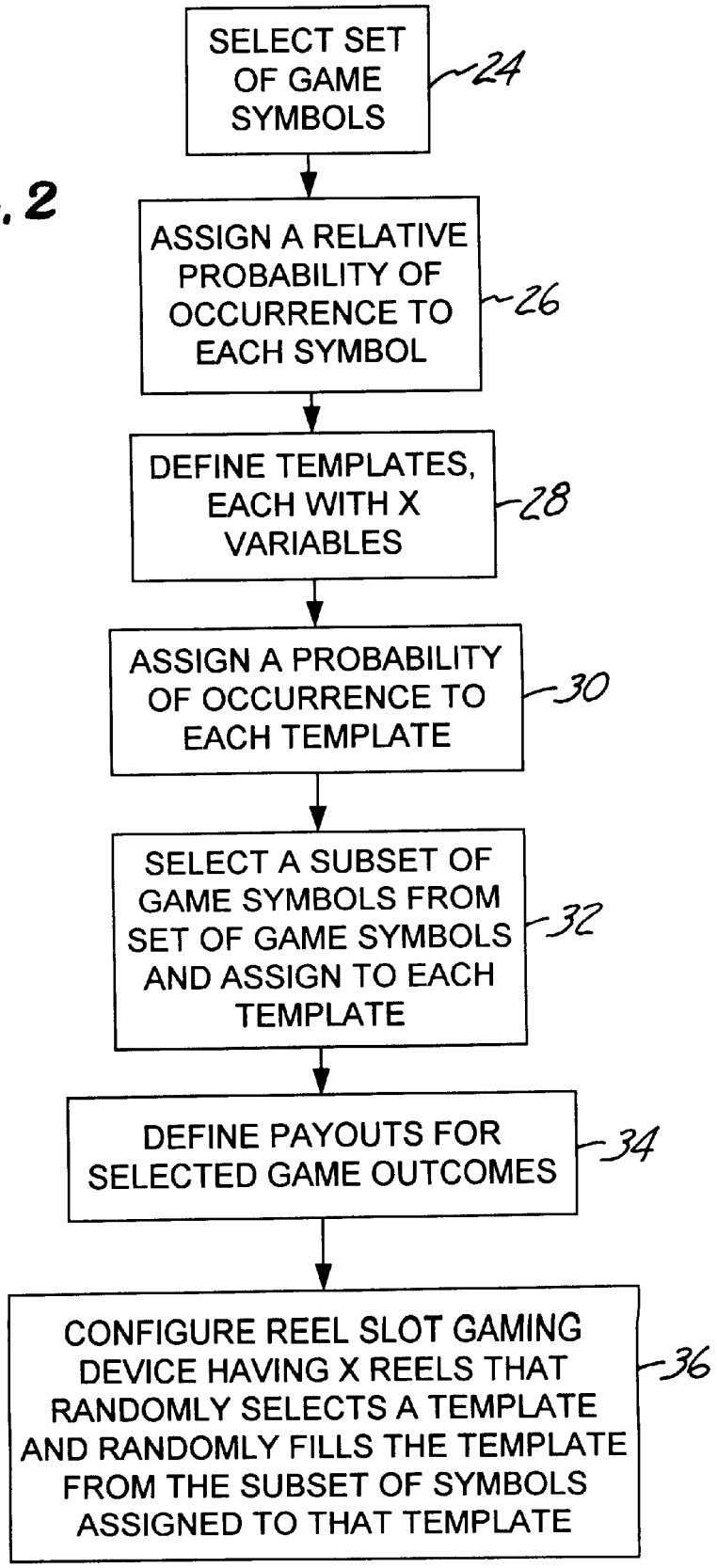
FIG. 2 is a flow diagram illustrating the steps of the method of the present invention.

Referring now to FIG. 2, according to the method of the present invention, the first step in designing a reel-slot game is to select a set of game symbols 24. For example, a preferred set of game symbols is a doubler symbol, a seven symbol, a single bar symbol, a double bar symbol, a triple bar symbol, a cherry symbol and a blank. Preferably, the set of game symbols is subdivided into a plurality of symbol groupings of one or more symbols. Preferably, symbols within a given grouping perform a same or similar function. In the first example, the set of game symbols is divided into the following groupings:

TABLE I

| Symbol Grouping | Symbol |
|---|---|
| 1 | Doubler Symbol |
| 2 | Seven |
| 3 | Triple Bar, Double Bar, Single Bar |
| 4 | Cherry |
| 5 | Blank |

Although in this example, only the third grouping of symbols includes more than one symbol, the present invention contemplates including one or more symbols in each symbol grouping. The number of symbol groupings defining a game can vary according to the present invention. In the example, seven symbols define the entire set of game symbols. The game designer may choose a wide variety of symbols, and group them in any manner desired.

Although the game symbols in the first example are conventional slot symbols, any symbols capable of being distinguishable from other symbols in the group can be used according to the method of the present invention. For example, a deck of 52 conventional cards could define the group of game symbols. The game symbols in this example are: thirteen groupings of four each, corresponding to Aces, Kings, Queens, Jacks, Tens, nines, eights, sevens, sixes, fives, fours, threes and twos. The game symbols can be grouped by suit, by face value, or by rank, for example. The symbols could also be numbers, colors, shapes, letters, symbols representing food, images of famous people or any number of other visual illustrations.

The next step according to the method of the present invention is to assign a relative probability of occurrence to each symbol 26. In the preferred example of the method of the present invention, the following symbol probabilities are shown in Table II below:

TABLE II

| Symbol | Relative Frequency | Probability |
|---|---|---|
| Doubler Symbol | 1 | 0.003584 |
| Seven | 2 | 0.007168 |
| Triple Bar | 6 | 0.021505 |
| Double Bar | 20 | 0.071685 |
| Single Bar | 50 | 0.179211 |
| Cherry | 100 | 0.358423 |
| Blank | 100 | 0.358423 |
| Total | 279 | 1 |

The probability of occurrence of each individual symbol is the relative frequency of occurrence of that symbol divided by the total number of symbol occurrences. For example, the relative probability of occurrence of blank is 100/279 or 0.358.

According to the method of the present invention, the game designer next selects a plurality of outcome templates 28. What is meant by an "outcome template" for purposes of this disclosure is a combination of X variables which are defined by the random selection of symbols from a subset of game symbols assigned to the selected template. Each template therefore represents one or more possible combinations of symbols. According to the present invention, the number of variables within each template defining the game remains constant. According to the preferred method, each template has three variables, each corresponding to an outcome on each of three reels on a slot machine.

Each template is preferably defined by a combination descriptor, a range of possible symbol values for each element of that combination descriptor and an optional position flag. The combination descriptor describes the number of and type of game symbols which will appear in the final outcome, without regard for the order. For example, the combination descriptor A A A represents an outcome of three identical symbols. The order of appearance is unimportant in this example, because the symbols by definition must be identical. In contrast, the combination descriptor A B C (with no position flag) represents three different symbols, appearing in no particular order.

Certain letters, for example, A, B and C are identified as "active" elements, while other letters, for example, X, Y and Z are identified as "inactive elements" in the templates. The "active" and "inactive" requirements are constraints placed on each template variable. Game templates can include active, inactive or combinations of active and inactive elements. What is meant by an "active" element for purposes of this disclosure is a variable that is filled by one or more symbols in an outcome that is a winning combination. An "inactive" element for purposes of this disclosure is a variable filled by one or more symbols in a losing outcome. The same symbol which may be active in one template may be inactive in another template, according to the present invention. Certain designated "active" symbols may also be combined with "inactive" symbols to form a winning outcome. The present invention therefore also contemplates the use of templates that have a combination of active and inactive symbols which produce winning outcomes. According to the preferred method of the present invention, only combination descriptors having at least one active element produce winning outcomes.

According to the method of the present invention, each template is assigned a relative probability of occurrence 30. The game designer assigns the relative probabilities to the templates, independent of the probabilities of the individual game symbols.

The method of the present invention includes assigning a subset of symbols from the set of game symbols to each template 32. The subsets of symbols in Table IV below are defined by the "range", "grouping", "restriction" and "position flag" information.

Range and grouping information are provided for each individual template, according to the preferred method. Restriction and position flag information is optionally assigned to each template.

The range information defines the minimum and maximum number of symbols from each symbol grouping that can be used to fill each variable in the template. The range information has been defined in Table IV, below, in terms of the symbol groupings identified in Table I, above. However, it is not necessary to tabulate the information in this manner. In the preferred game of the present invention, seven symbols are arranged in symbol groupings one through five.

For example, template 2 has a combination descriptor AAA. According to the range and grouping information, the "A" symbol can be selected from symbol groups 2, 3 or 4. There is a maximum of one symbol from each of the symbol groups, according to the "maximum grouping" information provided and a minimum of zero symbols from groups 2, 3 and 4. Referring back to Table I, variable A can be either a seven, a triple bar, a double bar, a single bar or a cherry.

The subset of symbols assigned to template 2 defines the possible outcomes as:

seven, seven, seven
triple bar, triple bar, triple bar
double bar, double bar, double bar
single bar, single bar, single bar
cherry, cherry, cherry Template 3 is defined by the combination descriptor AAB. Variable A includes a restriction. A is restricted to a symbol from symbol grouping 1. That is, A must be a double symbol. The maximum and minimum value is one from symbol group 1. As to the value of B, it must be a symbol that is different from A because the combination descriptor AAB requires A and B be different. B is selected from the groups 2, 3 or 4. The possible symbols used to fill the variable for B is therefore a seven, triple bar, double bar, single bar and cherry. The subset of symbols corresponding to template 3 defines all possible outcomes as:

double symbol, double symbol, seven
double symbol, double symbol, triple bar
double symbol, double symbol, double bar
double symbol, double symbol, single bar
double symbol, double symbol, cherry Position flags place additional requirements on how the template is filled. In the game utilizing the templates defined in Table IV, the position flags are all equal to zero. In other words, this example of the game does not include positional wins. In order to change the game to one which requires a positional win, the "zero" for a certain outcome is changed to a 1. For example, template 5 is ABB. A is restricted to a double symbol. This combination in another example is designed to pay only if the A is in the first position. The position flag information in this example is 1, 0, 0.

According to the method of the present invention, payouts are defined 34 and are assigned to each outcome. The payout can be zero or greater. Payouts of zero correspond to losing outcomes.

In the example described above, the preferred pay table is as follows:

TABLE III

| Pay Table | |
|---|---|
| Combination | Pays |
| DS DS DS | 800 |
| 7 7 7 | 80 |
| TB TB TB | 40 |
| DB DB DB | 25 |
| BR BR BR | 10 |
| CH CH CH | 10 |
| AB AB AB | 5 |
| Any 2 CH | 5 |
| Any 1 CH | 2 |

Where DS is double symbol, 7 is a red seven, TB is a triple bar, DB is a double bar, BR is a single bar, AB is any bar and CH is cherry.

In addition to the pay table defined above, the following additional rules apply to scoring a game configured according to the preferred method of the present invention: A double symbol functions as a wild card and is used to complete any winning combination. Double symbols double the value of a winning combination when used to complete that combination. A cherry in any position on the pay line is a winner. Two cherries in any position on the pay line is also a winner.

The templates preferably describe all possible outcome combinations. According to the present invention, a reel slot gaming device having X variables is next configured 36. The game microprocessor is programmed to select a template and the template variables are defined by the random selection of symbols from the subset of symbols assigned to the template. According to the method of the present invention, the symbols from the subset are randomly selected, and the order in which each variable is defined is also randomly selected. When there is a position flag that has been assigned to the template, the flagged position is filled first. In the example summarized below in Table IV, no position flags have been identified.

Table IV summarizes the preferred subsets of symbols corresponding to each game template, numbered one through seventeen. It should be noted that in this example, templates one to seventeen represent all possible outcomes for the selected set of game symbols in the game designed according to the preferred method of the present invention. In another example, the templates defining all game outcomes defines fewer than all possible outcomes for a given set of game symbols. For example, the game designer might want to eliminate a percentage of the outcomes that are losers, such as all outcomes containing blanks.

TABLE IV

| Template Number | Combination Descriptor | Active/ Inactive | Range Minimum Grouping 12345 | Range Maximum Grouping 12345 | Position Flags |
|---|---|---|---|---|---|
| 1 | AAA | Active | 10000 | 10000 | 000 |
| | | Inactive | N/A | N/A | |
| 2 | AAA | Active | 00000 | 01110 | 000 |
| | | Inactive | N/A | N/A | |
| 3 | AAB | Active | 10000 | 11110 | 000 |
| | | A Restrict | 10000 | N/A | |
| | | Inactive | N/A | | |
| 4 | AAB | Active | 00200 | 00200 | 000 |
| | | Inactive | N/A | N/A | |
| 5 | ABB | Active | 10000 | 11110 | 000 |
| | | A Restrict | 10000 | N/A | |
| | | Inactive | N/A | | |
| 6 | ABC | Active | 10200 | 10200 | 000 |
| | | A Restrict | 10000 | N/A | |
| | | Inactive | N/A | | |
| 7 | ABC | Active | 00300 | 00300 | 000 |
| | | Inactive | N/A | N/A | |
| 8 | AAX | Active | 00010 | 00010 | 000 |
| | | Inactive | 00000 | 01101 | |
| 9 | ABX | Active | 10010 | 10010 | 000 |
| | | Inactive | 00000 | 01101 | |
| 10 | AXX | Active | 00010 | 00010 | 000 |
| | | Inactive | 00000 | 01101 | |
| 11 | AXY | Active | 00010 | 00010 | 000 |
| | | Inactive | 00000 | 01201 | |
| 12 | XXX | Active | N/A | N/A | 000 |
| | | Inactive | 00001 | 00001 | |
| 13 | XXY | Active | N/A | N/A | 000 |
| | | Inactive | 10000 | 10001 | |
| | | X Restrict | 10000 | | |
| 14 | XXY | Active | N/A | N/A | 000 |
| | | Inactive | 00000 | 01101 | |
| 15 | XYY | Active | N/A | N/A | 000 |
| | | Inactive | 10000 | 10001 | |
| | | X Restrict | 10000 | | |
| 16 | XYZ | Active | N/A | N/A | 000 |
| | | Inactive | 10000 | 11101 | |
| | | X Restrict | 10000 | | |
| 17 | XYZ | Active | N/A | N/A | 000 |
| | | Inactive | 00000 | 01201 | |

As another example of how the combination descriptor and assigned subset of symbols defines all possible combinations for the selected template, the subset of symbols corresponding to template 7 will be described. The minimum and maximum symbol groupings indicate that there is a minimum and maximum of three symbols from grouping 3. Grouping 3 includes single, double and triple bars. Combination descriptor ABC indicates that the template must be filled with three separate active symbols. The combination descriptor ABC describes six possible outcomes. They are:

TABLE V

| |
|---|
| single bar, double bar, triple bar |
| single bar, triple bar, double bar |
| double bar, single bar, triple bar |
| double bar, triple bar, single bar |
| triple bar, double bar, single bar |
| triple bar, single bar, double bar |

Since there are no "position flags" for template 7, the order in which each symbol from grouping 3 appears in the outcome is not important. Templates including active and inactive elements list the active and inactive ranges separately. For example, template 8 is AAX. The inactive portion of the template, X is selected from groups 2, 3 or 5. Referring back to the table of groupings, X can therefore be a seven, any bar or a blank.

During play of the game, a random number generator which is preferably an integral part of the microprocessor selects the game template, based on the assigned probability of occurrence of all templates. The template probabilities are chosen by the game designer.

The specific symbols which fill the template are randomly selected from the subset of symbols assigned to that template, based on the relative probability of occurrence of all eligible symbols for that template. Positions requiring active elements are randomly filled first, and then positions requiring inactive elements are randomly filled.

Another feature of the method of the present invention is that the random number generator selects the order in which the positions within the template are filled. If a position restriction exists in a template, that variable is filled first; then the remaining symbols are randomly selected to define the outcomes. The microprocessor then instructs the reels to stop at the positions which cause the pay line to display the selected symbols.

The frequency of occurrence for each template in the example described above is shown in Table VI below:

TABLE VI

| Template No. | Frequency of Occurrence |
|---|---|
| 1 | 1 |
| 2 | 2,000 |
| 3 | 200 |
| 4 | 5,000 |
| 5 | 400 |
| 6 | 400 |
| 7 | 10,000 |
| 8 | 10,000 |
| 9 | 1,000 |
| 10 | 15,000 |
| 11 | 15,000 |
| 12 | 17,000 |
| 13 | 15,000 |
| 14 | 30,000 |
| 15 | 10,000 |
| 16 | 10,000 |
| 17 | 70,000 |
| Total | 269,001 |

The probability of occurrence of each individual template is the frequency of occurrence of the template divided by the total number of occurrences of all templates in the game. For example, the probability of occurrence of any combination of symbols represented by template 17 is 0.2602 (70,000/269,001). The individual probability of occurrence of each possible outcome within a given template is dependent in part upon the probability of occurrence of each symbol in the outcome, as well as the probability of occurrence of the selected template.

Table VII is a summary of all possible outcomes and probabilities for template 3:

TABLE VII

| Outcome | Probability |
|---|---|
| DS DS 7 | $8.35 \times 10^{-6}$ |
| DS DS TB | $2.51 \times 10^{-5}$ |
| DS DS DB | $8.35 \times 10^{-5}$ |
| DS DS BR | 0.000209 |
| DS DS CH | 0.000418 |

where "DS" is double symbol, "7" represents a seven, "TB" is triple bars, "DB" is double bars, "BR" is single bars and "CH" is cherry.

The probability of occurrence of each individual outcome in the set defined by template 3 is calculated from the template. The individual probability of occurrence of each possible symbol for an active element is summed, and identified as a denominator. The numerator is the assigned probability of occurrence of the selected symbol, times the probability assigned to the template. The probability of occurrence for a given outcome for a given template is the template probability, times the symbol probability, divided by the denominator. For example, for the template 3 outcome DS DS 7, the probability of occurrence is 0.000743 (assigned template probability)×0.007168 (assigned probability of a "7")/(0.007168+0.02211505+0.071685+0.179211+0.358423) (sum of the probabilities of all possible symbols permitted for filling in template 3 (DS DS B)).

As another example, all possible outcomes of template 2 (A A A) are outlined in Table VIII below:

TABLE VIII

| Outcome | Probability |
|---|---|
| 7 7 7 | $8.35 \times 10^{-5}$ |
| TB TB TB | 0.000251 |
| DB DB DB | 0.000835 |
| BR BR BR | 0.002088 |
| CH CH CH | 0.004177 |

The probability of occurrence of 7 7 7 is the template probability, multiplied by the individual probability of occurrence of a seven, divided by the sum of probabilities of each possible symbol in the subset of symbols corresponding to template 2. The probability of occurrence of three sevens on the pay line is therefore 0.007435×0.007168/(0.007168+0.021505+0.071685+0.179211+0.358423), or $8.353\times10^{-5}$.

Once the probability of occurrence of each winning outcome template is assigned, the method of the present invention includes assigning a pay value to each outcome. The probability of occurrence of each winning outcome, times the pay value for the combination, equals the total pay. The winning combinations are those that have a payout.

Table IX is a summary of the possible symbol combinations of the game designed according to the preferred method of the present invention. Each symbol combination has a pay value, the template number from which the combination originated, the probability of occurrence of the symbol combination, the assigned pay value, and the total amount paid to the player:

TABLE IX

| Combination | Template | Prob. | Freq. | Pays | Total Pay |
|---|---|---|---|---|---|
| DS DS DS | 1 | $3.72 \times 10^{-06}$ | 269001 | 800 | 0.002974 |
| DS DS 7 | 3 | $8.35 \times 10^{-06}$ | 119705 | 320 | 0.002673 |
| DS DS TB | 3 | $2.51 \times 10^{-05}$ | 39902 | 160 | 0.00401 |
| DS DS DB | 3 | $8.35 \times 10^{-05}$ | 11971 | 100 | 0.008354 |
| DS DS BR | 3 | 0.000209 | 4788 | 40 | 0.008354 |
| DS DS CH | 3 | 0.000418 | 2394 | 40 | 0.016708 |
| DS 7 7 | 5 | $1.67 \times 10^{-05}$ | 59853 | 160 | 0.002673 |
| DS TB TB | 5 | $5.01 \times 10^{-05}$ | 19951 | 80 | 0.00401 |
| DS DB DB | 5 | 0.000167 | 5985 | 50 | 0.008354 |
| DS BR BR | 5 | 0.000418 | 2394 | 20 | 0.008354 |
| DS CH CH | 5 | 0.000835 | 1197 | 120 | 0.016708 |
| DS AB AB | 6 | 0.001487 | 673 | 10 | 0.01487 |
| DS CH Any | 9 | 0.003717 | 269 | 10 | 0.037175 |
| 7 7 7 | 2 | $8.35 \times 10^{-05}$ | 11971 | 80 | 0.006683 |
| TB TB TB | 2 | 0.000251 | 3990 | 40 | 0.010025 |
| DB DB DB | 2 | 0.000835 | 1197 | 25 | 0.020885 |
| BR BR BR | 2 | 0.002088 | 479 | 10 | 0.020885 |

TABLE IX-continued

| Combination | Template | Prob. | Freq. | Pays | Total Pay |
|---|---|---|---|---|---|
| CH CH CH | 2 | 0.004177 | 239 | 10 | 0.041769 |
| AB AB AB | 4, 7 | 0.055762 | 18 | 5 | 0.278809 |
| Any 2 CH | 8 | 0.037175 | 27 | 5 | 0.185873 |
| Any 1 CH | 10, 11 | 0.111524 | 9 | 2 | 0.223047 |
| | | 0.219334 | | | 0.923191 |
| | | Hit Freq. | | | Return % |

The sum of the total pays for all possible winning combinations is the percentage return to the player. In the example, the hit frequency for the game is 0.219 and the percent return to the player is 92.32%. Table X below is a summary of the templates selected to define the preferred game.

TABLE X

| Template Number | Combination Description | Freq. | Prob. |
|---|---|---|---|
| 1 | DS DS DS | 1 | $3.72 \times 10^{-6}$ |
| 2 | A A A | 2000 | 0.007435 |
| 3 | DS DS B | 200 | 0.00743 |
| 4 | A A B | 5000 | 0.018587 |
| 5 | DS B B | 400 | 0.001487 |
| 6 | DS B C | 400 | 0.001487 |
| 7 | A B C | 10000 | 0.037175 |
| 8 | A A X | 10000 | 0.037175 |
| 9 | DS B X | 1000 | 0.003717 |
| 10 | A X X | 15000 | 0.055762 |
| 11 | A X Y | 15000 | 0.055762 |
| 12 | X X X | 75000 | 0.278809 |
| 13 | DS DS Y | 15000 | 0.055762 |
| 14 | X X Y | 30000 | 0.111524 |
| 15 | DS Y Y | 10000 | 0.037175 |
| 16 | DS Y Z | 10000 | 0.037175 |
| 17 | X Y Z | 70000 | 0.260222 |
| | | 269001 | |

The last step of the present method includes configuring a reel-slot gaming device to randomly select an outcome template from a set of game templates, based on the probability of occurrence of each template. Each variable in the template is filled from the subset of symbols assigned to the selected template. The symbols are randomly selected according to the probability of occurrence assigned to the symbol. If one or more positions in the template include a position flag, those variables are filled first. Preferably, active symbols are filled before inactive symbols.

Figure 3:
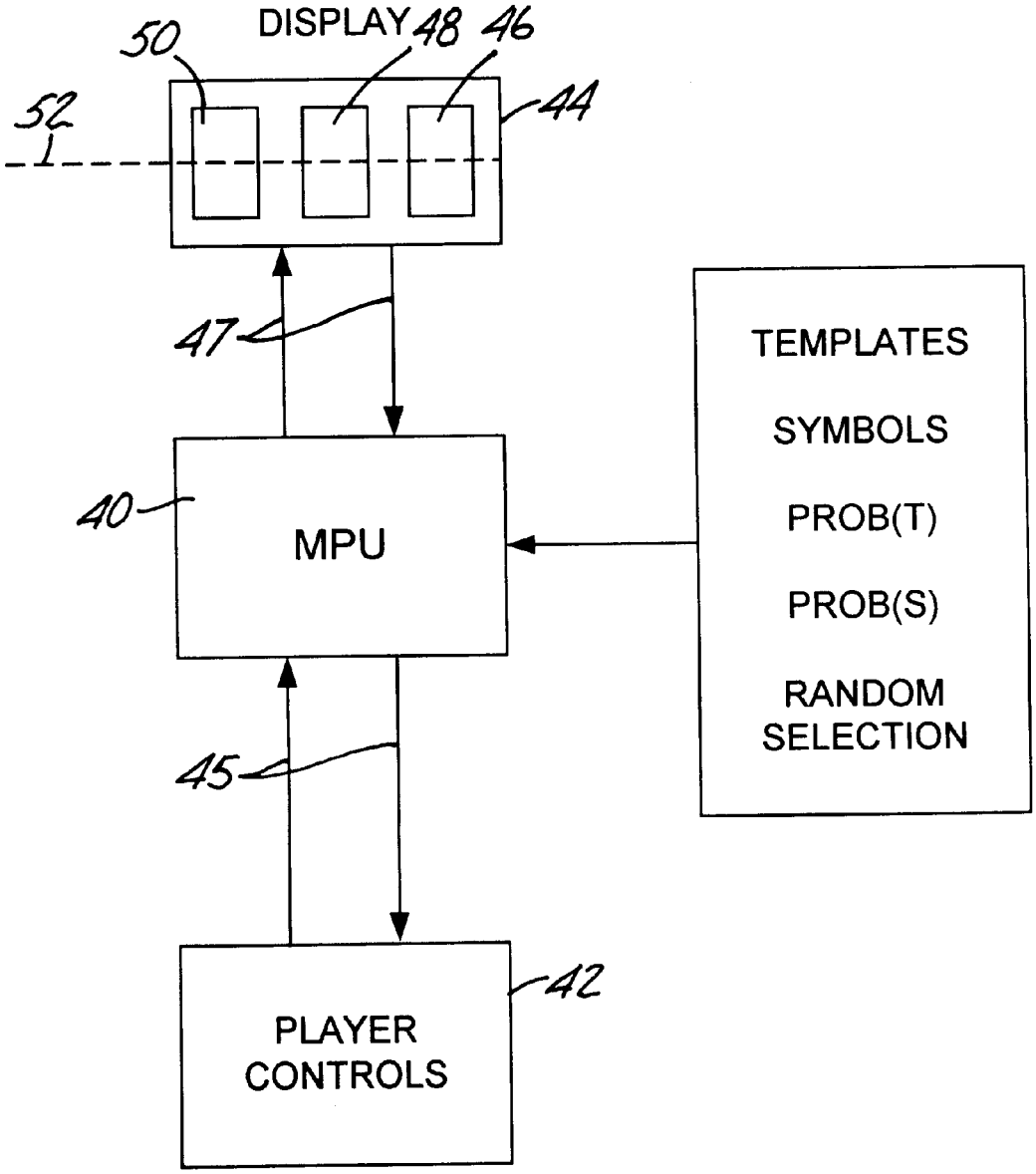
FIG. 3 is a diagram of the device of the present invention.

The present invention is a reel slot wagering device as illustrated diagrammatically in FIG. 3. The device includes a cabinet (not shown). Mounted within the cabinet is a microprocessor 40, player controls 42 and a visual display comprising a mechanical reel slot mechanism 44. The player controls 42 and reel slot mechanism 44 are electronically connected for communication with microprocessor 40 via data busses 45 and 47. Each reel 46, 48 and 50 is mounted for rotation about a common central axis S2. The visual display preferably includes at least one pay line 16 (shown in FIG. 1).

The microprocessor is equipped with a random number generator, and is programmed with a set of game symbols, a relative probability of occurrence assigned to each game symbol, a plurality of outcome templates, each having X variables, and an assigned relative probability of occurrence of each template. The microprocessor is further programmed to provide a subset of game symbols corresponding to each template. The microprocessor is also programmed with a pay table. That is, a preselected number of symbol combinations, or outcomes and corresponding pay values are included in the programming. Upon placing a wager, the wagering device of the present invention randomly selects an outcome template, and then randomly selects a plurality of game symbols for filling the variables in the template from a subset of symbols corresponding to that template. If the outcome produces a win, the device pays the player an award according to the pay table.

Preferably, the device of the present invention defines the subset of game symbols by range and symbol grouping as described above according to the method of the present invention. Similarly, optional position flags and restrictors are provided.

In the most preferred device of the present invention, X is equal to 3. Alternatively, the device of the present invention utilizes more or fewer variables, such as 2, 4, 5, 6 or 7, for example. The templates are preferably defined as described in the discussion of the method, above, including the use of combination descriptors, the preferred seven symbols, five corresponding symbol groupings and the preferred pay table.

Although the present invention has been described with reference to preferred embodiments, workers skilled in the art will recognize that changes may be made in form and detail without departing from the spirit and scope of the invention.

What is claimed is:

1. A method of configuring a reel-slot gaming device to randomly generate game outcomes, comprising the steps of:

selecting a set of game symbols;

assigning a probability of occurrence to each game symbol;

selecting a plurality of outcome templates, each template defining at least one combination of X variables, wherein X is a positive integer greater than 1;

selecting a probability of occurrence for each outcome template, wherein at least one template produces at least one game outcome having a probability of occurrence which is different from the probability of occurrence of an outcome of those same symbols and game symbol probabilities based on random occurrence;

assigning a subset of game symbols from the set of game symbols to each template for defining outcomes for each variable;

defining payouts for selected outcomes; and configuring a reel-slot gaming device having X reels, which randomly selects an outcome template, randomly selects a symbol from the subset of game symbols assigned to the selected template to fill each variable in the template, fills at least a portion of the template randomly with the selected symbols and displays the selected symbols on a pay line.

2. The method of claim 1, wherein the subset of game symbols for filling at least one template comprises an active element.

3. The method of claim 1, wherein the subset of game symbols for filling at least one template comprises an inactive element.

4. The method of claim 1, wherein all of the selected outcome templates define fewer than all possible game outcomes.

5. The method of claim 1 wherein the set of game symbols consists of 7 symbols, and X is equal to 3.

6. The method of claim 5, wherein the set of game symbols consists of: a doubler, a seven, a triple bar, a double bar and a single bar, a cherry and a blank, and the payouts are as follows:

| Symbol Combination | Pays |
|---|---|
| 3 Doublers | 800 |
| 3 Sevens | 80 |
| 3 Triple Bars | 40 |
| 3 Double Bars | 25 |
| 3 Single Bars | 10 |
| 3 Cherries | 10 |
| 3 of any Bars | 5 |
| 2 Cherries | 5 |
| 1 Cherry | 2. |

7. The method of claim 1, wherein at least one winning combination includes at least two different symbols.

8. The method of claim 1, wherein at least one winning combination is a positional win.

9. The method of claim 1, wherein each template is defined by a combination descriptor.

10. The method of claim 9, wherein each subset of symbols is further defined by at least one selected symbol grouping, and a range of selected symbol groupings which can be used to fill the corresponding template.

11. The method of claim 9, wherein each template includes a variable that is filled by at least one of an active element and an inactive element.

12. The method of claim 9, and further including a positional flag in the template, wherein the positions assigned positional flags are filled first.

13. The method of claim 1, wherein seventeen templates define the game.

14. A reel-slot wagering device, comprising:

a cabinet;

player controls mounted in the cabinet;

a plurality of reels rotatable about a central axis and mounted for rotation in the cabinet;

a visual display with at least one pay line; and a microprocessor mounted in the cabinet, wherein the microprocessor is equipped with a random number generator, and is programmed with a set of game symbols, an assigned relative probability of occurrence of each game symbol, a plurality of outcome templates defining at least one combination of X variables, wherein X is a positive integer greater than 1, an assigned relative probability of occurrence of each template; a subset of game symbols assigned to each template, and a preselected group of winning combinations and corresponding pay values;

wherein the random number generator randomly selects an outcome template, and then randomly selects a plurality of game symbols for filling in the template from the subset of game symbols assigned to the template and awards a payout if the symbols on the pay line correspond to one of a preselected group of winning symbol combinations, wherein at least one template produces at least one game outcome having a probability of occurrence which is different from the probability of occurrence of an outcome of those same symbols and game symbol probabilities based on random occurrence.

15. The apparatus of claim 14, wherein the subset of game symbols is defined by a range, a symbol grouping, and optionally a position flag and restrictor.

16. The apparatus of claim 14, wherein X is equal to 3.

17. The apparatus of claim 14, wherein each template is defined by a combination descriptor.

18. The apparatus of claim 14, wherein the game symbols are: a doubler, a seven, a triple bar, a double bar and a single bar, a cherry and a blank.

19. The apparatus of claim 18, wherein the preselected group of winning symbol combinations and payouts are as follows:

| Symbol Combination | Pays |
|---|---|
| 3 Doublers | 800 |
| 3 Sevens | 80 |
| 3 Triple Bars | 40 |
| 3 Double Bars | 25 |

-continued

| Symbol Combination | Pays |
|---|---|
| 3 Single Bars | 10 |
| 3 Cherries | 10 |
| 3 of any Bars | 5 |
| 2 Cherries | 5 |
| 1 Cherry | 2. |

20. The method of claim 10, wherein the subset of symbols corresponding to each template is further defined by a position restrictor and position flag.

* * * * *